US008888606B2

(12) United States Patent
Boccieri

(10) Patent No.: US 8,888,606 B2
(45) Date of Patent: Nov. 18, 2014

(54) GOLF GRIP

(75) Inventor: Stephen Boccieri, Scottsdale, AZ (US)

(73) Assignee: Heavy Putter, Scottsdale, AZ (US)

( * ) Notice: Subject to any disclaimer, the term of this patent is extended or adjusted under 35 U.S.C. 154(b) by 240 days.

(21) Appl. No.: 13/443,415

(22) Filed: Apr. 10, 2012

(65) Prior Publication Data

US 2012/0302364 A1 Nov. 29, 2012

Related U.S. Application Data

(60) Provisional application No. 61/490,455, filed on May 26, 2011.

(51) Int. Cl.
*A63B 53/14* (2006.01)

(52) U.S. Cl.
USPC ..... 473/297

(58) Field of Classification Search
CPC ..... A63B 53/145; A63B 59/0029
USPC ..... 473/296–299, 300–303
See application file for complete search history.

(56) References Cited

U.S. PATENT DOCUMENTS 2,261,959 A * 11/1941 Buttikofer ..... 473/285
2,782,035 A * 2/1957 East ..... 473/297
2,960,133 A * 11/1960 Shepherd, Jr. ..... 81/22
4,017,082 A * 4/1977 Channing et al. ..... 473/285
4,461,479 A 7/1984 Mitchell
4,600,195 A 7/1986 Hunter
4,674,746 A * 6/1987 Benoit ..... 473/297
4,690,407 A 9/1987 Reisner
4,763,899 A 8/1988 Hundley
4,822,052 A * 4/1989 Dimmick et al. ..... 473/285
4,988,102 A 1/1991 Reisner
5,004,239 A * 4/1991 Wettstein ..... 473/282
5,058,891 A * 10/1991 Takeuchi ..... 473/201
5,152,533 A * 10/1992 Radakovich ..... 473/206
5,244,209 A * 9/1993 Benzel ..... 473/297
5,322,290 A 6/1994 Minami (Continued)

FOREIGN PATENT DOCUMENTS

JP 11-319172 A 11/1999
JP 4507266 B1 7/2010

OTHER PUBLICATIONS

International Preliminary Report on Patentability of Nov. 26, 2013 for PCT International Application No. PCT/US2012/034253, International Filing Date Apr. 19, 2012.

(Continued)

*Primary Examiner* — Stephen L. Blau
(74) *Attorney, Agent, or Firm* — Novak Druce Connolly Bove + Quigg LLP

(57) ABSTRACT

A weighted grip for a golf club is disclosed. The weight is preferably a metal, such as iron and its alloys, especially steel, copper and its alloys, such as brass and bronze, tungsten and its alloys, especially tungsten, aluminum and its alloys, ceramics, including cermets, and can take the form of a cylindric shape concentric with the grip, and embedded in the moldable composition forming the grip. In other embodiments the weight can be at, or near, the extreme end of the grip. Other shapes, forms and locations of the weight are disclosed, as well as combinations of the weight with a grip formed of a moldable composition having a heavy filler therein. The combination of the grip and a golf club are also disclosed.

33 Claims, 4 Drawing Sheets

(56) References Cited

U.S. PATENT DOCUMENTS

| | | | | |
|---|---|---|---|---|
| 5,427,376 | A * | 6/1995 | Cummings et al. | 473/201 |
| 5,482,993 | A | 1/1996 | Hiraoka | |
| 5,766,088 | A | 6/1998 | Severtsen | |
| 5,782,443 | A * | 7/1998 | La Fontaine | 248/156 |
| 6,223,829 | B1 * | 5/2001 | Wiens | 172/1 |
| 7,250,006 | B2 * | 7/2007 | McGonigle | 473/285 |
| 7,399,235 | B2 * | 7/2008 | Gill et al. | 473/297 |
| 7,458,902 | B2 | 12/2008 | Gill | |
| 7,828,670 | B1 * | 11/2010 | Schroader | 473/285 |
| 7,909,705 | B2 * | 3/2011 | Gill et al. | 473/297 |
| 8,062,147 | B2 * | 11/2011 | Johnson | 473/303 |
| 2002/0165070 | A1 | 11/2002 | Pullaro | |
| 2004/0053715 | A1 | 3/2004 | Schwieg et al. | |
| 2004/0147339 | A1 | 7/2004 | Lindner | |
| 2004/0229710 | A1 * | 11/2004 | Huang | 473/300 |
| 2004/0266546 | A1 | 12/2004 | Huang | |
| 2006/0009303 | A1 | 1/2006 | Prince et al. | |
| 2006/0063618 | A1 * | 3/2006 | Okamoto | 473/519 |
| 2006/0142093 | A1 * | 6/2006 | Moriyama | 473/292 |
| 2011/0124431 | A1 | 5/2011 | Karube | |
| 2011/0159982 | A1 * | 6/2011 | Takeuchi | 473/299 |
| 2012/0046136 | A1 * | 2/2012 | Allen et al. | 473/563 |

OTHER PUBLICATIONS

International Search Report dated Nov. 23, 2012 from corresponding international application PCT/US2012/034253.

* cited by examiner

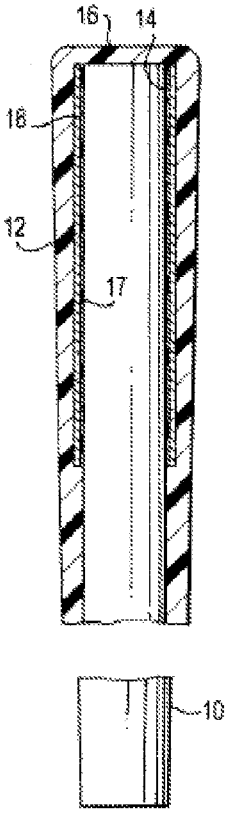
FIG. 1
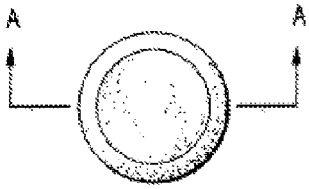
FIG. 2
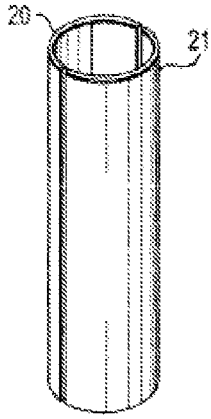
FIG. 3
FIG. 4
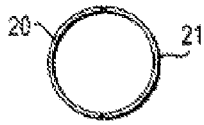
FIG. 5
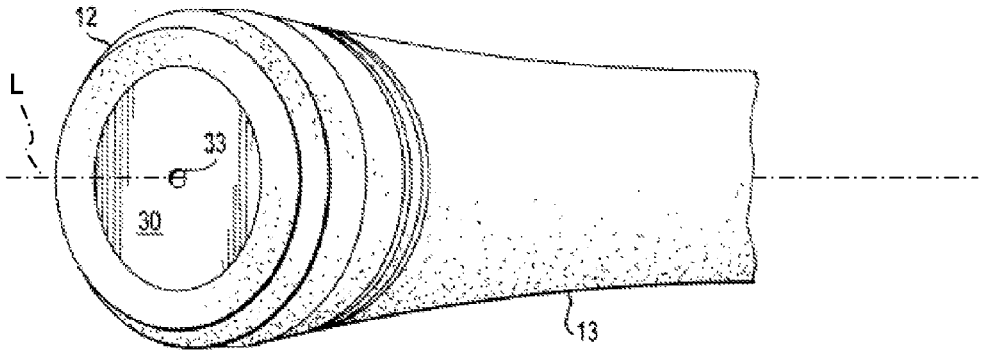

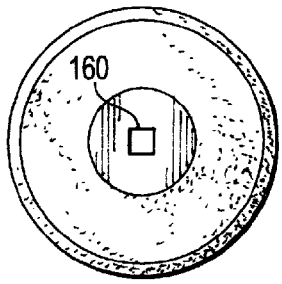
FIG. 15
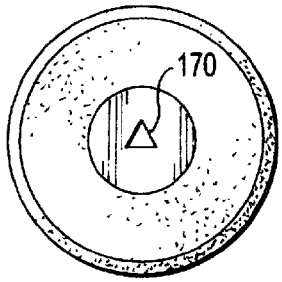
FIG. 16
FIG. 17
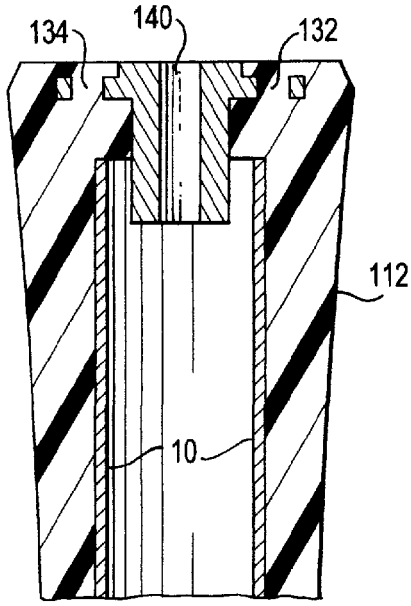

GOLF GRIP

CROSS REFERENCE TO RELATED APPLICATIONS

This application is a non-provisional application claiming the benefit of U.S. provisional patent application Ser. No. 61/490,455, filed May 26, 2011, the entire disclosure of which is hereby incorporated by reference in its entirety.

BACKGROUND OF THE INVENTION

1. Field of the Invention

The present invention is directed to balance compensating golf grips and golf clubs incorporating the balance compensating golf grip.

2. Description of the Prior Art

The game of golf requires, among other things, the use of golf clubs to strike the golf ball.

Golf clubs are formed by the head, or striking element, of the club, intended to impact the golf ball. The head can take many shapes and be formed of differing materials, thereby causing the head to have differing weights. The head is connected to a shaft for imparting the swing to the head. The shafts themselves may also be formed of differing materials, such as wood, metal, and composites such as graphite fiber filled polymer. The length of the shafts are also variable to the player, depending on height and physical ability of the player. All these variations introduce balance variability to the club and head combination.

At the end of the shaft opposite the head is the golf grip. The grip is intended to be grasped by the golfer in order to swing the club. The present rules of golf require that the grip not contain any contour that would assist in placement of the golfer's hands on the grip (an exception is made for the putter). Therefore, most existing golf grips are circular in cross-section and concentric with the axis of the shaft, (though the cross-section generally diminishes in size from the end of the grip in a direction towards the exposed portion of the shaft).

Until the present invention, there has not been taken into account the fact that the imbalance caused by the variabilities in the club head and shaft combination could be counterbalanced by the golf grip, and the present invention discloses various ways in which the golf grip can be modified to compensate for this imbalance.

SUMMARY OF THE INVENTION

In one embodiment, the present invention applies weight within the golf grip to compensate for the imbalance caused by the club head and shaft.

In another embodiment, weight is applied to the composition of which the grip is formed by incorporating a heavy filler into the composition to increase the weight of the grip.

In another embodiment, a metal weight is incorporated into the grip such that it surrounds, but is spaced from the shaft, and concentric with the axis of the shaft.

In another embodiment of the invention, a metal weight is incorporated near the end of the grip, overlying but spaced from the end of the shaft, and not surrounding any portion of the shaft.

The weight is preferably a metal, such as iron and its alloys, especially steel, copper and its alloys, such as brass and bronze, tungsten and its alloys, aluminum and its alloys, ceramics, including cermets.

In a still further embodiment, the metal weight, which is incorporated near the end of the grip, can at least extend into an interior space formed by the end of a hollow shaft. In such an embodiment, the metal weight extending into the space in the end of the shaft can be exposed, or alternatively be covered by the composition of the grip. In either of these embodiments, it is important that the exterior surface of either the metal weight, or the composition covering the metal weight, never contacts the interior circumference of the shaft.

In a further embodiment, a grid or lattice of metal, may be impregnated by the material forming the grip, with the grid or lattice being formed into a split cylinder.

In a still further embodiment, more than one, or all, of the foregoing embodiments may be used in combination to form the golf grip of the invention.

These, and other embodiments of the invention, will be better understood when read in conjunction with the appended drawings and the detailed description of the preferred embodiments.

BRIEF DESCRIPTION OF THE DRAWINGS

FIG. 1 is a schematic cross-section of a golf grip according to one embodiment of the invention in which a metal weight is incorporated concentrically about the end of the shaft of a golf club;

FIG. 2 is a schematic representation along line A-A of FIG. 1;

FIG. 3 is a schematic representation, in a perspective view, of one form of the weight used in the golf grip of FIG. 1;

FIG. 4 is a schematic representation along a top view of the weight of FIG. 3;

FIG. 5 is a schematic representation of a golf grip according to another embodiment of the invention in which a weight is incorporated near the end of the grip, overlying, but spaced, from the end of the shaft;

FIG. 15 is a schematic view of an alternative embodiment of the central aperture in the weight illustrating a square cross-section to assist in aligning the weight relative to the grip;

FIG. 16 is an alternative embodiment to the shape of the aperture shown in FIG. 15; and, FIG. 17 is a schematic, partially cross-sectioned view through the finished grip illustrating an extension of the weight into the end of a hollow shaft.

DETAILED DESCRIPTION OF THE PREFERRED EMBODIMENTS

Figure 6:
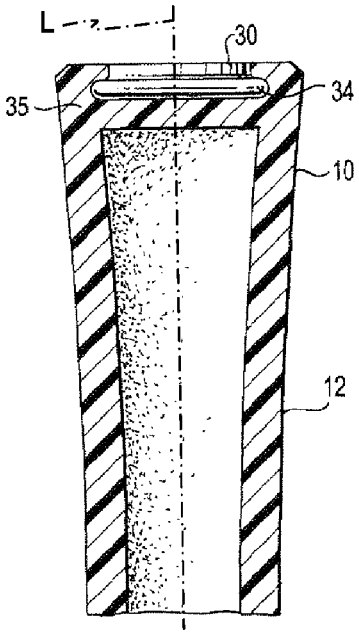
FIG. 6 is a schematic, cross-section, of the grip shown in FIG. 5.
Figure 8:
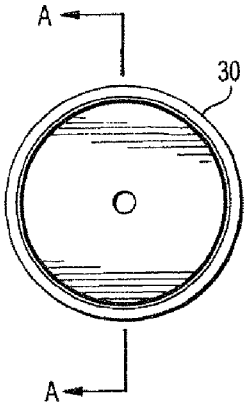
FIG. 8 is a schematic representation of the weight shown in FIG. 5.

FIG. 1 illustrates a golf club shaft 10, one end of which is attached to the head (not shown) and the other end of which is attached to golf grip 12. The materials of construction of golf grip 12 can be any moldable materials, such as natural or synthetic rubbers or polymers possessing the elastomeric and shock absorbing properties of, or similar to, rubbers. Such materials are usually compounded with a filler, to reduce the volume of the more expensive rubbers or polymers. The invention contemplates that heavy fillers are also incorporated into the materials of construction of grip 12 to raise the weight of the grip. It is desirable to mold the grip from a composition having a density of from 1.1-1.8 g/cc, preferably 1.4-1.8 g/cc. We have found that a composition employing fillers of barium sulphate and white carbon in rubber will achieve the desired density of 1.4-1.8 g/cc. However, the provision of fillers in particulate form is at best, random, and does not concentrate the weight in the grip where desired to achieve the counterbalancing function of this invention. It is also preferrable that the exterior surface of the grip does not slip from the golfer's hands during the swing and so the exterior surface of the grip is sometimes provided with a textured surface 13 (FIGS. 5, 7) providing better hand feel and aiding in the grip by the golfer.

When assembled on the golf club shaft 10, the golf grip 12 extends about the circumference of hollow shaft 10 with the golf grip overlying the end 14 of shaft 10 as shown at 16 in FIG. 1. Although we have illustrated a hollow metal shaft, it is well within the skill of one in the golf club art to provide hollow or solid shafts depending on the nature of the material used for the shaft, e.g., wood, metal, composites, such a graphite-filled polymers, etc.

In one embodiment of the invention, a weight 18 is placed in a mold so as to be at least partially, or alternatively, fully encapsulated by the materials of construction of golf grip 12 as shown in FIG. 1. This weight may take the form of a cylindric tube as shown in FIG. 1, or preferably, can be formed of two halves 20, 21 (FIG. 3) to facilitate placement of the weight in the mold and the final position in the molded grip. The thickness of the cylindric half 20 may be on the order of 0.039 inches and may be 2 and ¾ inches long. These values are given for a weight formed of mild steel. When the metal used is denser, such as tungsten, these thicknesses and lengths will result in a greater weight per volume. It is within the scope of the invention to raise the weight of a golf grip to 92+/−3 grams, preferably to at least 95 grams, or more, if one or more of the embodiments disclosed herein are used in combination. The inner diameter of the weight should be greater than the outer diameter of golf club shaft 10 such that the interior walls of the weight 18 (or the interior of assembled halves 20, 21) has a coating of the grip material of construction thereon as shown at 17 in FIG. 1. This makes the grip 12 easier to install on shaft 10, does not bring the surface of weight 18 into direct contact with shaft 10 and cushions the grip 12. The mass of weight 18 can be varied to counterbalance the variabilities introduced to the balance of the golf club by the size and weight of the golf club head (not shown) and the golf club shaft 10.

In other embodiments, weight 18 (or halves 20, 21) can be provided with apertures therein to permit the materials of construction of grip 12 to permeate the weight. These apertures can be single or numerous throughholes of any shape (e.g., round, elongated, quadrilateral, hexagonal, etc.) but preferably are either round or quadrilateral. In some aspects the holes are so numerous that the weight 18 begins to resemble a grid or lattice and thus many layers of weighted material can be positioned or wound to form the final weight. This provision of apertures, or grid/lattice structure, assures intimate contact of the materials of construction with weight 18. Of course, bonding agents, surface roughness and other aids to assure intimate bonding of the weight to the materials of construction of grip 12 can also be employed in combination.

The weights described herein are preferable formed of a metal, and suitable metals include iron and its alloys, including steel, and other dense metals. While lead and gold would have the density to make them viable candidates, the cost of gold and the environmental disposal of lead reduce their likelihood as suitable metals. We particularly prefer tungsten and its alloys for use as the material of choice for the weighted golf grip of the invention. Tungsten has a high density of 17 grams per cubic centimeter. When used in the embodiments discussed herein, the weighted golf grip of the invention may be made 40% to 90% heavier than the conventional golf grip. This additional weight aids in counterbalancing the golf club on which it is installed. While we have mentioned tunsten alone, or with its alloys, as the preferred metals, it is within the scope of the invention to use equivalent weight of non-tungsten containing metals. In such cases, the volume of the non-tunsten containing metals would be larger in order to approach the equivalent weight of a tungsten, or tunsten alloy weight. Such metals include copper and its alloys, examples of which are brass and bronze, iron and its alloys, including different grades of steel, aluminum and its alloys, ceramics and cermets.

In an alternate embodiment, a weight may be placed at the extreme end of a golf club, thereby providing the most significant counterbalance per unit weight during the swing of the golf club. In this embodiment, shown in FIG. 5, a weight 30 is placed at the extreme end of the grip 12 and may be at least partially visible at its upper surface. It is also within the scope of the invention to have the weight 30 completely covered at the end of the grip so that it is not visible. The covering could be the molding composition itself, or a separate piece placed over the weight 30, which separate piece is joined to, or captured by, the grip composition. This weight could also made of the same materials as discussed herein, but preferable is made of tungsten alone, or tunsten and its alloys. A single cubic centimeter of tungsten would introduce 17 grams of weight at the extreme end of the grip 12. The weight 30 can take several forms, including the provision of an aperture 32 (FIG. 9) into which the grip material 33 can flow as well as the provision of stud 39 which can extend into the material of grip 12. Not only does aperture 32 and stud 39 assure a bond of the weight 30 to grip 12, but as shown in FIG. 6, a flange 34 can be formed into weight 30 such that it is captured by the grip 12, as shown in the partially cross-sectioned view of FIG. 6. As shown in FIG. 6, a boundary 35 of grip material extends between the end of shaft 10 and weight 30.

Figure 9:
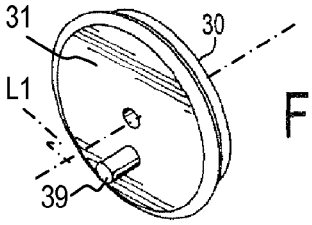
FIG. 9 is a schematic, perspective view of another embodiment of the weight shown in FIG. 8.

FIGS. 5 and 6 show a longitudinal axis L of the grip 12. FIG. 9 shows a longitudinal axis L1 of the weight 30. The weight 30 has a disc shaped portion 31 and a stud 39. The longitudinal axis L1 of the weight 30 embedded in the end of the grip 12 aligns and overlaps with the longitudinal axis L of the grip 12 as shown in FIG. 5. The weight 30 is transverse to the longitudinal axis L to surround the longitudinal axis L of the grip 12.

Figure 12:
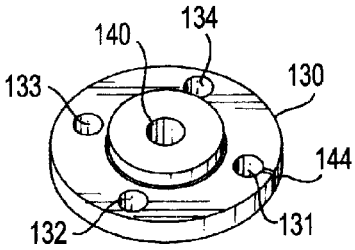
FIG. 12 is a schematic representation of a further embodiment of the invention in which a weight is provided with several through holes, or apertures, through which can flow the moldable material of the grip.

FIG. 12 shows an alternative disc-shaped weight 130.

In the alternative embodiment to the weight 30 as shown in FIG. 5 is that shown in FIG. 12. FIG. 12 illustrates a further embodiment of a weight 130, which weight 130 has a plurality of apertures or holes. These apertures 131, 132, 133, 134, are present such that the moldable material of the grip can penetrate though weight 130 during molding of the grip to securely maintain the weight 130 in the desired position in the grip. The apertures 131, 132, 133, and 134 can have a non-circular configuration, or they may be circular in cross-section. Although we have illustrated four apertures, they may be more, or less than four, e.g., two, three, five, or more. It is preferable that the apertures are uniformly placed about the axis of the weight 130 to avoid introducing unintended variations into the weight distribution. However, it is also within the scope of the invention to intentionally introduce weights having a non-uniform distribution of mass. One or more of the apertures could contain an indicator, such as slot 144 (FIG. 12) so as to assist in orientation of the weight 130 in a certain location in the mold. Alternatively, or in addition to slot 144, there could be various shapes of the central aperture itself (FIG. 15, where central aperture 160 is square; FIG. 16, where central aperture 170 is triangular) which may act as an orienting element of the weight relative to the moldable material of the grip, and/or relative to the position of the grip on the shaft. This is especially desirable when indicia or a design are carried on the exposed portion of the weight and it is desired to orient such indicia or design. It may also be useful when the mass of the weight is not uniformly distributed and it is desired to orient the non-uniform mass in a particular orientation to the grip and/or shaft.

While we have illustrated several shapes, it is to be expressly understood that any shape which can act as an orienting element can be used. Non-limiting examples of such shapes include quadrilaterals, such as rectangles, trapezoids and rhomboids, pentagonal, hexagonal, septagonal, octagonal, etc. as well as part circular with a flat portion, or circular with an extending slot, e.g., keyhole shaped. During the molding of the moldable grip composition, a mandrel may cooperate with the orienting element to orient the weight relative to the grip.

Figure 13:
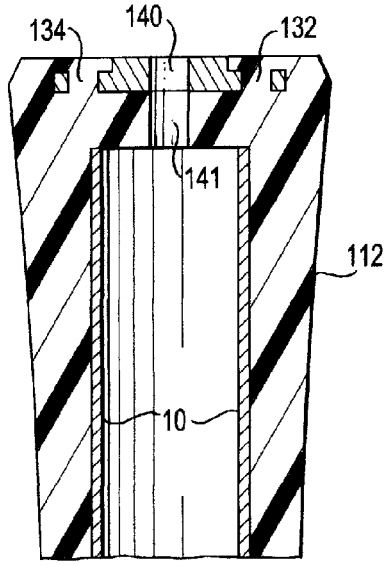
FIG. 13 is a schematic, partially sectioned view, of a grip incorporating the weight of FIG. 12.

As shown in the partially cross-sectional view of FIG. 13, the moldable material of the grip extends through the apertures to securely hold and position weight 130 relative to the grip. A central aperture or vent hole 140 is also contained in this weight, which vent can be extended through the moldable material 141 to aid in installing the grip on a shaft of the golf club. The vent 140 and vent 141 act in cooperation to let any trapped air escape from the grip. This is especially desirable when the shaft is solid in cross section, or where the shaft is already fitted to the club head, or in any situation in which air is trapped during installation of the grip, whether in newly manufacturing golf clubs or in replacing existing grips on the clubs.

Figure 14:
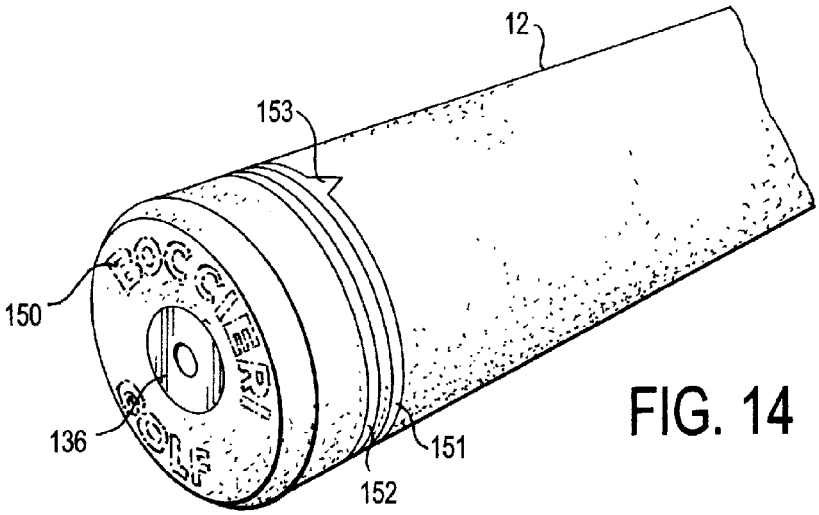
FIG. 14 is a schematic, perspective view of a grip incorporating the weight of FIG. 12.

As shown in the partial cross sectional view of FIG. 13, and in the perspective view of FIG. 14, the exterior, exposed surface 136 of weight 130 is substantially smaller than that shown in the embodiment of FIG. 5. This is due to the stepped nature of weight 130, as compared to the weight 30. This permits more of the moldable compound to show at the distal end of the grip (opposite the club head) and itself may form a location for the placement of indicia, such as the grip maker's name, the golf club maker, or even a particular country club or organization.

However, as stated above, the weight 30, or 130, may be completely covered by the moldable compound, or an insert placed over the weight, such that the weight is not visible art all.

Indicia 150 can also be placed on or in the moldable composition of the grip itself as shown in FIG. 14. The indicia 150 can be the grip maker's name, a trademark, a design, the golf club maker's name, etc.

Figure 7:
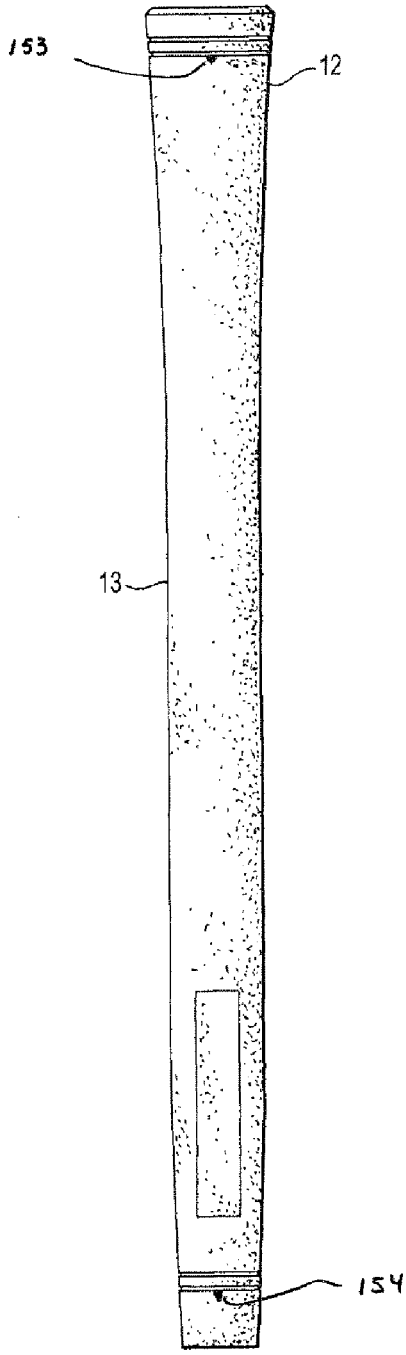
FIG. 7 is a schematic of the exterior shape of the grip of FIG. 5.
Figure 10:
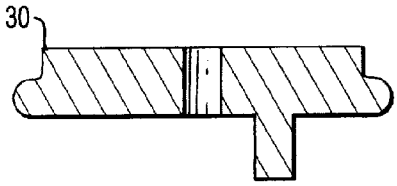
FIG. 10 is a schematic, cross-sectioned view along line A-A of the weight of FIG. 9.

Furthermore the outer surface of the grip can be provided with distinctive, or ornamental, markings as shown at 151, 152 in FIG. 14. Furthermore, these distinctive marking can serve a functional purpose, e.g., an arrowhead 153, or other indicator, can be used to assist in aligning the grip upon installing the same on the shaft of the golf club. As shown in FIG. 7, a second marking, i.e., an arrowhead is shown at the lower end of grip 13, which can also be of use to the grip installer, in combination with arrowhead 153, to assure that the grip is not twisted when the grip 13 is installed on the shaft 10. Alternatively, or in addition to markings 153, 154, additional arrowheads, or indicators, (not shown) may exist spaced 180° from markings 153, 154, to also assist in aligning the grip 13 on the shaft 10. When purely ornamental, the markings have no functional purpose.

Figure 11:
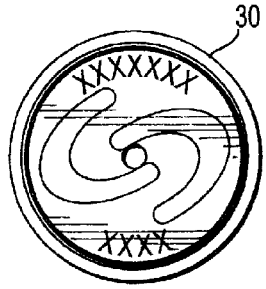
FIG. 11 is a schematic top view of the weight of FIG. 9, showing that indicia may be placed thereon.

Nonetheless, in each of these embodiments it is preferable to employ a weight at, or near, the extreme end of the grip to produce a significant counterbalancing value. The weight can also provide a place for indicia, such as the owner's initial(s), a club's logo, etc, as shown in FIG. 11. However, as compared to conventional monogramming caps, weight 30 (or 130) is 850% heavier than such monogramming caps.

When the weight is made of a less dense material, such as aluminum or its alloys, it may be necessary to increase the mass of such lighter material to the extent that the total mass cannot occupy a space between the end of the shaft and the end of the grip. In such a case, the weight 30 (or 130) may be forced to extend into the space surrounded by the shaft when the grip is mounted on the shaft. In such an embodiment, as shown in FIG. 17, a tail of the weight will extend into the end of the shaft. The tail may be bare metal, or may be covered by the molding composition, which is unitary with the remainder of the grip. However, in either embodiment, it is important that neither the bare metal of the tail, or the molding composition covering the tail, contact the interior surface of the shaft as such would introduce undesirable vibrations from the club striking a ball to the shaft and then directly to the weight in the grip. Thus, it is always desirable to have a clearance between the weight and the shaft.

While I have disclosed the invention with regard to several embodiments, these embodiments are to be considered as exemplary only, and not limiting, as it will be apparent to those skilled in the art, upon reading this disclosure, that various modifications may be made without departing from the spirit and scope of the invention.

I claim:

1. A golf club grip having a weight therein, the grip comprising:

a moldable composition; the moldable composition being molded about a metallic weight;

the weight being at least partially encapsulated by the moldable composition, wherein the weight surrounds a portion of a longitudinal axis of the grip;

wherein the grip defines a shaft cavity for insertion therein of a golf club shaft, wherein the weight is at the extreme end of the grip, the weight overlying but spaced from an end of the shaft cavity, and not abutting any portion of the shaft cavity, wherein the weight does not extend beyond the moldable composition; and wherein the weight has at least one aperture therethrough and the molding composition extends through said aperture.

2. The grip of claim 1, wherein the weight is at least one member selected from the group consisting of iron and its alloys, tungsten and its alloys, copper and its alloys, aluminum and its alloys, ceramics and cermets.

3. The grip of claim 2, wherein the moldable composition has a density in the range of 1.1-1.8 g/cc.

4. A golf club in combination with the grip of claim 3.

5. The grip of claim 1, wherein the weight is cylindric in shape.

6. The grip of claim 1, further comprising filler particles within the moldable composition and wherein the moldable composition comprises a natural or synthetic rubber or elastomeric polymer.

7. The grip of claim 1, weighing at least 89 grams.

8. The grip of claim 1, wherein the metallic weight consists of tungsten or tungsten alloy incorporated at the extreme end of the grip, overlying but spaced from the end of the shaft cavity and the weight is completely covered by the moldable compound such that the weight is not visible.

9. The grip of claim 1, wherein the moldable composition defines the shaft cavity.

10. The grip of claim 9, wherein the moldable composition of the grip is one piece.

11. A golf club grip having a weight therein, the grip comprising:

a moldable composition; the moldable composition being molded about a metallic weight, wherein the grip defines a shaft cavity for insertion therein of a golf club shaft;

the weight being at least partially encapsulated by the moldable composition, wherein the weight surrounds a portion of a longitudinal axis of the grip, wherein the weight is at the end of the grip, wherein the weight is disc shaped and has apertures therein.

12. The grip of claim 11, wherein the weight is at the extreme end of the grip.

13. The grip of claim 11, wherein the metallic weight is incorporated near the end of the grip, overlying but spaced from the end of the shaft cavity, and not surrounding any portion of the shaft cavity.

14. The grip of claim 11, wherein the metallic weight is made of tungsten or tungsten alloy and incorporated at the end of the grip, overlying but spaced from the end of the shaft cavity, wherein the weight is circular disc shaped comprising a lower portion of a first diameter and a central upper portion of a second diameter, the first diameter being greater than the second diameter such that the lower portion defines a circular flange extending radially from the central upper portion, the flange has the apertures therein, wherein the apertures are uniformly placed about the axis of the weight, wherein the flange is captured by the moldable composition and the moldable composition extends through the apertures, the central upper portion extends upwardly from the circular flange through a circular opening at the upper end of the moldable composition such that a circular upper wall of the central upper portion is an exterior exposed surface visible through the circular opening and flush with the upper end of the grip moldable composition.

15. A golf club grip having a weight incorporated within the grip at the extreme end of the grip, the weight being tungsten or tungsten alloy, wherein the weight is at least partially encapsulated by a moldable composition and surrounds a portion of the longitudinal axis of the grip;

wherein the grip defines a shaft cavity for insertion therein of a golf club shaft, the entire weight overlying but spaced from the end of the shaft cavity, and not abutting any portion of the shaft cavity, wherein the weight does not extend beyond the moldable composition.

16. The grip of claim 15, wherein the grip is formed of the moldable composition and the moldable composition has a density in the range of 1.1-1.8 g/cc.

17. The grip of claim 16, wherein the weight has at least one aperture therethrough and the molding composition extends through said aperture.

18. The grip of claim 17, wherein the weight has at least two apertures through which the molding composition extends.

19. The grip of claim 17, wherein the weight has at least four apertures through which the molding composition extends.

20. The grip of claim 19, wherein the apertures are uniformly placed about the axis of the weight.

21. The grip of claim 17, wherein the weight has a flange and the flange is captured by the moldable composition.

22. The grip of claim 16, wherein the grip weighs at least 89 grams.

23. A golf club in combination with the grip of claim 22.

24. A golf club grip being formed of a moldable composition having a density in the range of 1.1-1.8 g/cc having at least one weight at least partially encapsulated by the moldable composition;

the weight being at least one member selected from the group consisting of iron and its alloys, tungsten and its alloys, copper and its alloys, aluminum and its alloys, ceramics and cermets; and, the weight of the grip being at least 89 grams;

wherein the grip defines a shaft cavity for insertion therein of a golf club shaft, wherein the weight is at the extreme end of the grip, the entire weight overlying but spaced from the end of the shaft cavity, and not abutting any portion of the shaft cavity, wherein the weight does not extend beyond the moldable composition.

25. The grip of claim 24, wherein the weight being formed of a metal selected from tungsten and its alloys.

26. The grip of claim 24, wherein the weight has a density of at least 17 grams/cc.

27. The grip of claim 24, wherein the weight is a circular disc shaped weight having a lower portion of a first diameter and a central upper portion of a second diameter, the first diameter being greater than the second diameter such that the lower portion defines a circular flange extending radially from the central upper portion.

28. The grip of claim 24, further having at least one element to orient the weight relative to at least one of the grip or shaft.

29. The grip of claim 28, wherein the at least one element is selected from the group consisting of a slot in the weight, a flat sided aperture in the weight, and a keyhole aperture in the weight.

30. The grip of claim 24 having at least one element on the external surface of the grip to align the grip relative to the shaft.

31. The grip of claim 30, wherein the at least one element is an arrowhead.

32. A golf club grip having a metallic weight at the end of the grip, wherein the weight is at least partially encapsulated by a moldable composition and surrounds a portion of the longitudinal axis of the grip, wherein the weight has at least one aperture therethrough and the molding composition extends through said aperture.

33. The grip of claim 32, the grip defining a cavity for insertion therein of a golf club shaft, wherein the entire metallic weight is overlying but spaced from the end of the shaft cavity, and not abuting any portion of the shaft cavity.

* * * * *